US005199909A

United States Patent [19]

Molitor et al.

[11] Patent Number: 5,199,909

[45] Date of Patent: Apr. 6, 1993

[54] CONTACT SOCKET FOR CONNECTING FLAT CONTACT TONGUES

[75] Inventors: Paul Rainer Molitor, Mühldorf; Meinrad Jankowski, Töging, both of Fed. Rep. of Germany

[73] Assignee: Otto Dunkel GmbH Fabrik fur Elektrotechnische Gerate, Muhldorf/Inn, Fed. Rep. of Germany

[21] Appl. No.: 865,477

[22] Filed: Apr. 9, 1992

[30] Foreign Application Priority Data

Apr. 12, 1991 [DE] Fed. Rep. of Germany ..... 4112035

[51] Int. Cl.[5] ..... H01R 13/187

[52] U.S. Cl. ..... 439/843; 439/651; 439/745

[58] Field of Search ..... 439/851-856, 439/861, 862, 842-849, 676, 850, 745, 748, 651, 840, 841

[56] References Cited

U.S. PATENT DOCUMENTS

| | | | |
|---|---|---|---|
| 3,557,428 | 1/1971 | Bonhomme | 439/843 |
| 3,760,340 | 9/1973 | Friend | 439/847 |
| 4,734,063 | 3/1988 | Koch et al. | 439/844 |
| 4,979,915 | 12/1990 | Pitts | 439/851 |

FOREIGN PATENT DOCUMENTS

| | | | |
|---|---|---|---|
| 2064235 | 6/1981 | United Kingdom | 439/851 |

*Primary Examiner*—David L. Pirlot

*Attorney, Agent, or Firm*—Jacobson, Price, Holman & Stern

[57] ABSTRACT

The inventive contact socket serves to connect flat contact tongues as are used in plug-type connection devices for testing purposes, in particular in the manufacture of automobiles. The contact socket (1), which permits frequent plug-in cycles with small insertion forces being required, comprises a contact spring support with two bearing walls (2, 3) which are essentially parallel to one another. Said bearing walls (2, 3) are furnished on the inner side, preferably on both inner sides, with a respective row of contact springs (4) being curved such that a gap (5) opening elastically, with contact being established, when a flat contact tongue is inserted, is formed by the regions that are curved toward one another. The ends (6, 7) of each contact spring (4) are bent back toward one another on the outer side of the associated bearing wall (2, 3). The two bearing walls (2, 3) are interconnected via a transverse wall (12) determining their mutual spacing. A support wall (14) bordering the insertion gap (5) for the flat contact tongue is provided at the edges (13) of the bearing walls (2, 3) opposite the transverse wall (12).

4 Claims, 3 Drawing Sheets

Figure 1:
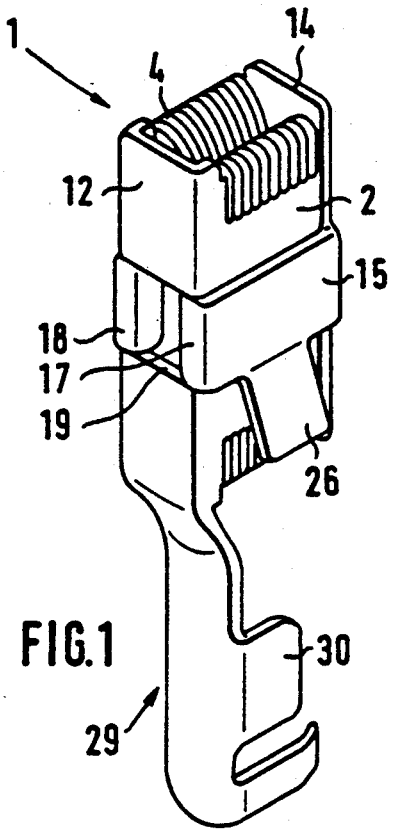

FIG.5
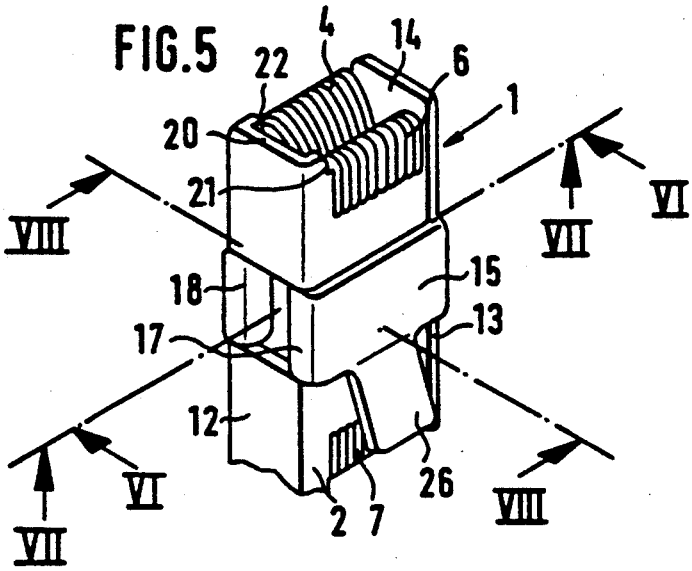
FIG.6
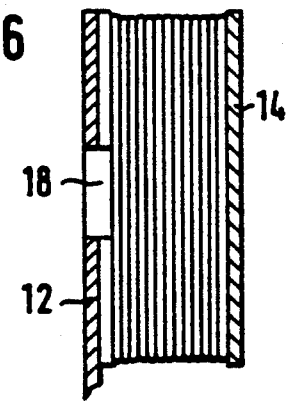
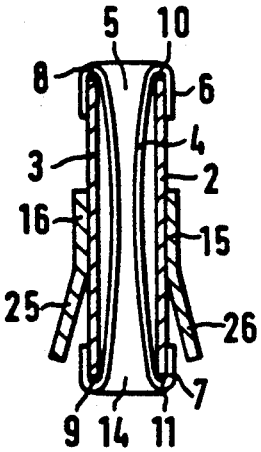
FIG.8
FIG.7
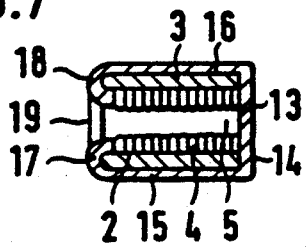

FIG. 9
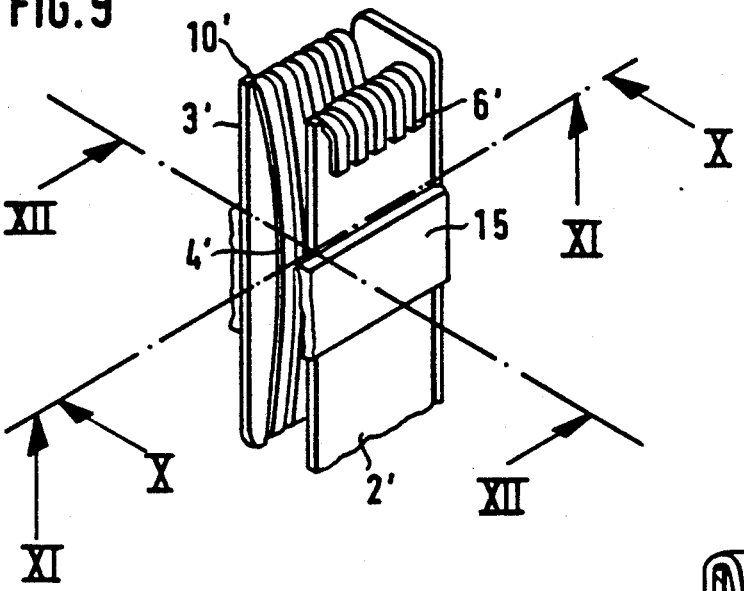
FIG. 10
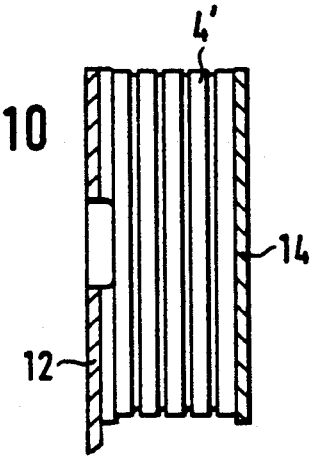
FIG. 12
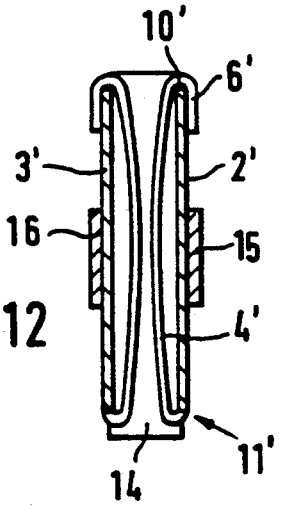
FIG. 13
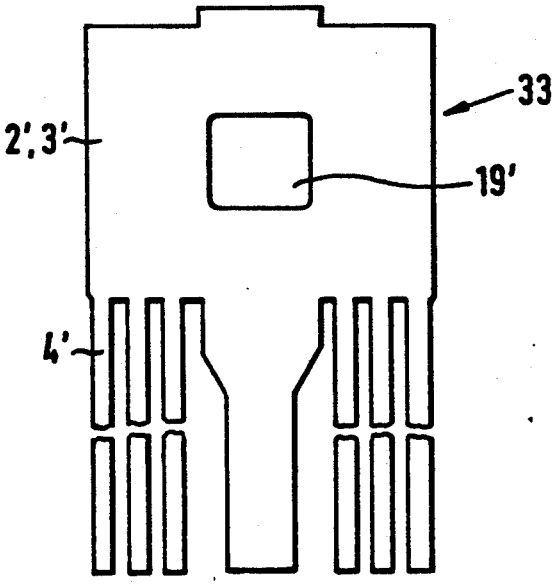
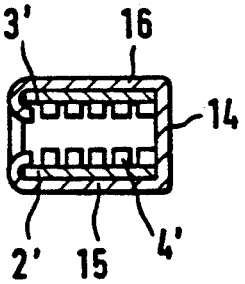
FIG. 11

CONTACT SOCKET FOR CONNECTING FLAT CONTACT TONGUES

The invention relates to a contact socket for connecting flat contact tongues. Contact systems of this type are widely used in the manufacture of automobiles, more particularly in power supply circuits of motor vehicles. Prior art contact sockets usually consist of a sheet-metal strip of a width larger than that of the flat contact tongues by a degree that allows the lateral strip zones to be bent approximately 270 degrees toward one another such that the strip edges end a small distance apart from the surface of the sheet-metal strip center portion. When establishing contact, the lateral edges of the contact spring tongue are pressed under, as it were, the inward rolled lateral strip zones of the sheet-metal strip of the contact socket. Although contact sockets of this type permit economical manufacture and require only little space, the contact provided mostly leaves something to be desired. Such contact sockets are not suitable for frequent plugging in and out. For this reason, they cannot be employed in plug-type connection devices for testing purposes as used especially in the manufacture of automobiles and in repair shops, for example for motor-vehicle error diagnosis.

According to the present invention, a contact socket that is simple in construction and permits frequent plug-in cycles while avoiding any adverse change in current-conduction resistance essentially is characterized by a contact spring support with two bearing walls essentially parallel to one another, the inner side thereof, preferably both inner sides thereof, each having a row of contact springs arranged on them which are curved such that a gap opening elastically, with contact being provided, when a flat contact tongue is inserted, is formed by the regions being curved toward one another. Thereby, multiple contact depending on the number of contact springs and thus high current loading capacity is guaranteed, while conduction resistance is low and only small insertion forces are required.

The contact springs each might be secured at one end, preferably at the end facing away from the flat contact tongue insertion side, to the associated bearing wall through a clamped or soldered connection. However, fixing and assembling will be particularly easy if the ends of each contact spring are bent back toward one another on the outer side of the associated bearing wall and if the distance between the two bending points of each contact spring in the stretched-out state is chosen greater than the distance between the bearing wall edges whereon the ends of the contact springs which are bent toward one another rest, by a degree that determines the size of the contact spring curvature. Given that the contact springs tend to return to their initial state with a greater curvature, in the assembled state the springs firmly rest on the bearing wall edges as a consequence of the spring being reckened and of the resulting smaller curvature, and an initial spring tension that is favourable with view to the contact to be established with the flat contact tongue is achieved.

Alternatively, instead of the above-mentioned clamped or soldered connection provided preferably at the end facing away from the flat contact tongue insertion side, according to the invention the contact springs may also be formed integrally with the respective associated bearing wall, with the bentback portion of said contact springs adjoining said bearing wall, and the respective free end of the contact springs may be bent back around the corresponding bearing wall edge. In this case the contact springs need to be bent back only at one end. As a consequence, assembly is extremely easy.

For the purpose of further simplification, each bearing wall together with the associated contact springs may be punched out from one metal sheet.

The bearing walls and contact springs may, of course, be punched out from sheet metal of constant thickness. However, there are made different demands on the bearing walls representing bearing or holding elements, respectively, than on the contact springs, for instance as regards their flexural strength. Therefore, according to the invention, the sheet metal from which the bearing wall and the associated contact springs are punched preferably is graduated in thickness. For example, the area of the sheet metal being intended to form the bearing wall may be thicker than the area being intended to form the contact springs.

In structural respects it has turned out to be extremely advantageous if the two bearing walls are interconnected via a transverse wall determining the mutual spacing between the bearing walls. In this way it is possible to form the contact spring support, which is the main component of the contact socket, as a uniform punched-out and bent part.

In another advantageous refinement, a support wall bordering the insertion gap for the flat contact tongue is provided at the edges of the bearing walls opposite the transverse wall.

This support wall might be fixed to the bearing wall edges through a welded or soldered connection. A simpler connection can be achieved if the support wall is provided with holding brackets bent at right angles and extending away from said support wall in the transverse direction, each of said holding brackets abutting the outer side of one of said bearing walls and ensuring fixed holding of the support wall on the contact spring support by means of their ends being bent toward one another.

To prevent axial displacement of the support wall relative to the contact spring support in a structurally simple manner, it has proven to be advantageous if the transverse wall has a cutout wherein the bent ends of the holding brackets of the support wall are engaged.

With view to an accurate position of the contact springs being arranged side by side it has turned out to be advantagous if the ends of the holding brackets are bent 180 degrees, extending along the respective bearing walls until adjoining the cutout, and if the front edges of the bearing walls starting at the front edge of the transverse wall are each provided with a recess beginning at a point where the ends of the holding brackets terminate and each defining the region of the bearing wall edges whereon the bent ends of the contact springs rest.

Furthermore, the invention relates to a test contact plug-in device with an insulating body having a plurality of through-holes for accommodating and releasably securing contact sockets showing the aforesaid features. This device distinguishes itself in that each contact spring support is associated with at least one locking tongue extending obliquely with respect to the axis of the insertion gap for the flat contact tongue, away from the outer side of the contact spring support, said locking tongue when inserted into the associated hole in the insulating body engaging a lateral locking shoulder provided in said hole. In this way it is possible to furnish test contact plug-in devices with contact sockets provided with contact springs and arranged at certain modular dimensions, which in case of need can be released again easily and replaced by new contact sockets.

In this context, it has proven to be advantageous in structural respects if a locking tongue is formed integrally with at least one of the two holding brackets of the support wall.

It is structurally advantageous if in a test contact plug-in device with a connecting projection for supply of current the connecting projection of each contact socket extends from the transverse wall connecting the bearing walls. In such case, according to another version of the invention the connecting projection may be provided with crimp brackets enabling fixed connection of a cable.

If, however, a test contact plug-in device with highly stressed contact sockets is concerned which, as it were, represent a wearing part, the connecting projection advantageously is in the form of an approximately round contact pin enabling easily releasable connection of a cable connected with a contact spring socket.

Further details, advantages and features of the invention emerge from the following description and the annexed drawing, to which express reference is made as regards all important details not mentioned in the description.

Figure 3:
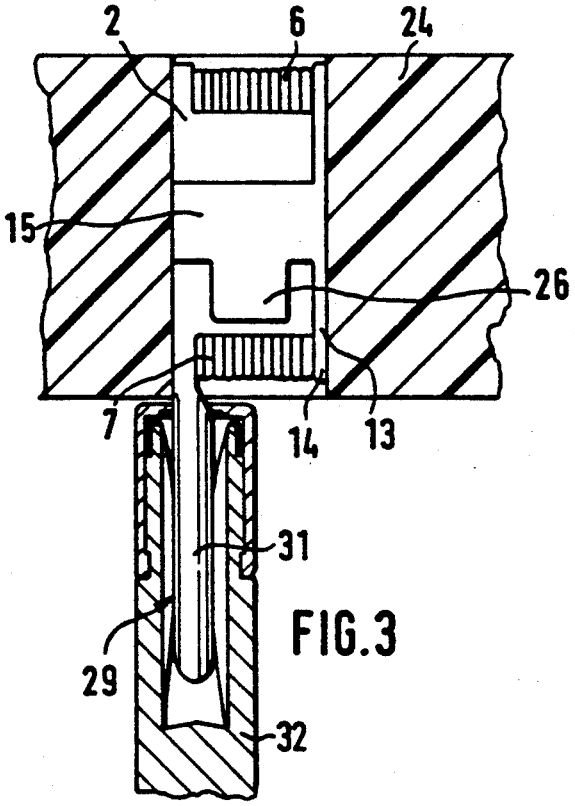
Figure 2:
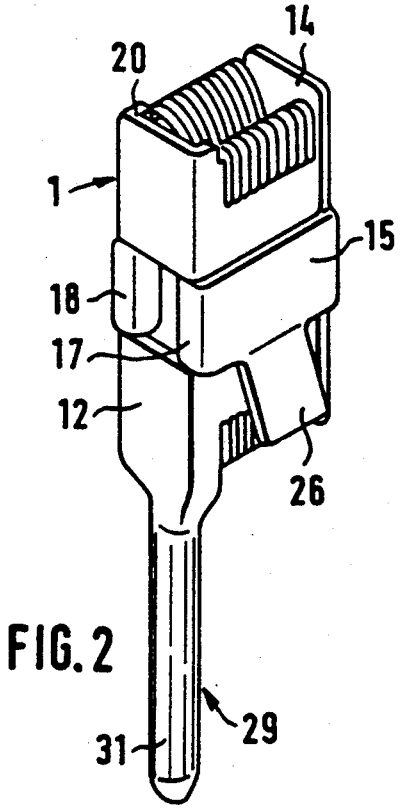
Figure 4:
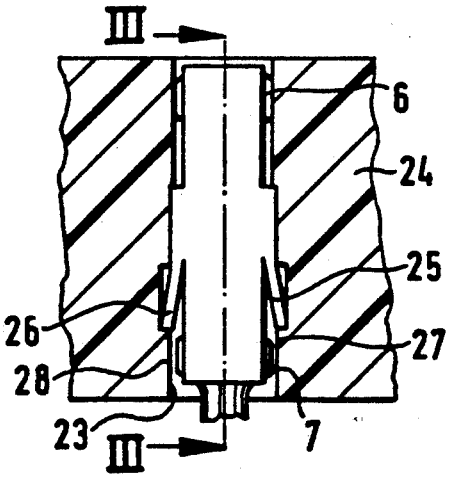

FIG. 1 is a perspective view of a contact socket with a cable connector having crimp brackets, FIG. 2 is a perspective view of a contact socket with a connector in the form of a round contact pin, FIG. 3 is a longitudinal section through a test contact plug-in device with a contact socket, FIG. 4 is a cross-section through the device shown in FIG. 3, FIG. 5 is a perspective view of the upper end of a contact socket according to a first embodiment of the invention, FIG. 6 is a sectional view of the contact socket along line VI—VI in FIG. 5, FIG. 7 is a sectional view of the contact socket along line VII—VII in FIG. 5, FIG. 8 is a sectional view along line VIII—VIII in FIG. 5, FIG. 9 is a perspective view of the upper part of a contact socket according to a second embodiment of the invention, FIG. 10 is a sectional view of the contact socket along line X—X in FIG. 9, FIG. 11 is a sectional view of the contact socket along line XI—XI in FIG. 9, FIG. 12 is a sectional view of the contact socket along line XII—XII in FIG. 9, and FIG. 13 is a top plan view of a support wall with associated contact springs according to the second embodiment of the invention, prior to their bending.

The contact socket illustrated in the drawing serves for the connection of flat contact tongues (not shown), in particular of flat contact tongues having dimensions of 5.7×0.7×7.5 mm or 2.8×0.7×7.5 mm, respectively, being standard dimensions in the manufacture of automobiles. It has a contact spring support 1 with two mutually parallel bearing walls 2, 3. On at least one inner side, preferably on both inner sides, of said bearing walls 2, 3 are arranged in each case a row of contact springs 4 which are curved such that a gap 5 is formed between the regions being curved toward one another, said gap opening elastically, with contact being established, when a flat contact tongue is inserted and contact is provided. In the embodiment of the invention illustrated in FIGS. 1 to 8 both ends 6, 7 of each contact spring 4 are bent back toward one another on the outer side of the associated bearing wall 2, 3. The distance between the two bent locations 8, 9 of each contact spring 4 in the stretched-out state is chosen greater than the distance between the bearing wall edges 10, 11 whereon the contact spring ends 6, 7 bent toward one another rest, by a degree determining the size of the contact spring curvature.

The two bearing walls 2, 3 are interconnected via a transverse wall 12 determining the mutual spacing between the bearing walls. A support wall 14 bordering the flat contact tongue insertion gap 5 is provided at the edges 10, 11 of the bearing walls 2, 3 opposite the transverse wall 12. The support wall 14 is provided with holding brackets 15, 16 which are bent at right angles and extend transversely away from said support wall 14. Said holding brackets 15, 16 each abut the outer side of one of the bearing walls 2, 3. They ensure, by means of their ends 17, 18 which are bent toward one another, that the support wall 14 is firmly held on the contact spring support 1.

The transverse wall 12 is provided with a cutout 19 in which are engaged the backward bent ends 17, 18 of the holding brackets 15, 16 of the support wall 14. Said ends 17, 18 of the holding brackets 15, 16 are bent 180 degrees and extend along the bearing walls 2, 3 until adjoining the cutout 19. The front edges of the bearing walls 2, 3 starting at the front edge 20 of the transverse wall 12 each have a recess 21, 22. These recesses begin at a point where the ends of the holding brackets 15, 16 terminate. These recesses each define the region of the bearing wall edges 10, 11 whereon the bent ends 6, 7 of the contact springs 4 rest.

FIGS. 3 and 4 illustrate the use of the inventive contact sockets in a test contact plug-in device with an insulating body 24 having a plurality of through-holes 23 for receiving and releasably securing such contact sockets. Each contact spring support 1 is provided with at least one, preferably two locking tongues 25, 26. These extend obliquely with respect to the axis of the insertion gap 5 for the flat contact tongue, away from the outer side of the contact spring support 1. In case of insertion into the associated hole 23 in the insulating body 24, each locking tongue 25, 26 engages a lateral locking shoulder 27, 28 located in the hole 23.

As can be seen in the drawing, the locking tongues 25, 26 are each formed integrally with one of the two holding brackets 15, 16 of the support wall 14.

The contact spring support 1 of each contact socket of the test contact plug-in device is provided with a connecting projection 29 for current supply. This connecting projection 29 extends from the transverse wall 12 which connects the bearing walls 2, 3. In the embodiment illustrated in FIG. 1, the connecting projection 29 is provided with crimp brackets 30 enabling fixed connection of a cable (not shown). According to the embodiment shown in FIG. 2, the connecting projection may be in the form of an approximately round contact pin 31. As shown in FIG. 3, said latter pin 31 enables easily releasable connection of a cable (also not shown) which is connected with a contact spring socket 32. In this structure the cable together with the contact spring socket 32 can easily be separated from the contact pin 31, in order to withdraw any contact socket being worn out as a result of frequent use from the hole 23 in the insulating body 24 and to replace it by a new contact socket.

FIG. 9 to 13 serve the purpose of illustrating a second embodiment of the invention. For identical elements, like reference numerals have been used. The second embodiment of the invention differs from the first one in that the contact springs 4' are narrow tongues formed ingetrally with the respective associated bearing wall 2', 3'. According to FIG. 12, right side, the backward bent sections of the contact springs 4' adjoin the bearing wall 2'. In this structure the transient point, designated by 11', of the bearing wall 2' where the tongue-shaped contact spring 4' begins replaces the edge 11 of the bearing wall 2 around which the end 7 extends as provided in the first embodiment (compare in particular FIG. 8). The contact spring 4' extends along the inner side of the bearing wall 2' to the edge 10' thereof, opposite the transient point 11'. The free end 6' of the contact spring 4' is bent back around the bearing wall edge 10'.

FIG. 13 shows a metal sheet 33. The upper part of the metal sheet 33 in FIG. 13 will form the bearing wall 2' and 3', respectively, of the contact socket to be manufactured from the metal sheet. In the lower part, a row of metal sheet strips has been formed by stamping, which strips serve as contact springs 4'. 19'designates an opening corresponding to the cutout 19 of the first embodiment. The metal sheet 33 may be thicker in its upper part intended to form the bearing wall 2' and 3', respectively, than in its lower part. Thereby it is possible to provide the bearing walls with the required rigidity and to provide the contact springs with the required resilient properties although the bearing wall and the contact springs are each produced from one single metal sheet.

We claim:

1. A contact socket for receiving a contact tongue, comprising a contact spring support with two bearing walls substantially parallel to one another, and a row of curved contact springs arranged on an inner surface of at least one of said walls to define an opening for a contact tongue between the springs and the other of said walls characterized in that opposite ends of each contact spring are bent back toward one another around opposite edges of said one bearing wall at bending points of the spring and that a distance between the bending points of each contact spring in a stretched-out state of the spring is greater than a distance between said edges by an amount determining the curvature of the contact spring.

2. A contact socket for receiving a contact tongue, comprising a contact spring support with two bearing walls substantially parallel to one another, and a row of curved contact springs arranged on an inner surface of at least one of said walls to define an opening for a contact tongue between the springs and the other of said walls characterized in that the contact springs are formed integrally with said one bearing wall at one edge of the bearing wall and each contact spring has a bent-back portion adjacent the inner surface of said bearing wall and a free end bent back around an opposite edge of the bearing wall.

3. The contact socket according to claim 2, characterized in that the bearing wall together with the associated contact springs is punched out from one metal sheet.

4. The contact socket according to claim 3, characterized in that the metal sheet is graduated in thickness.

* * * * *